United States Patent [19]

Crail et al.

[11] Patent Number: 4,949,092

[45] Date of Patent: Aug. 14, 1990

[54] MODULARIZED CONTOURED BEAM DIRECT RADIATING ANTENNA

[75] Inventors: Timothy A. Crail, Los Angeles; Sanford S. Shapiro, Canoga Park, both of Calif.

[73] Assignee: Highes Aircraft Company, Los Angeles, Calif.

[21] Appl. No.: 323,175

[22] Filed: Mar. 15, 1989

Related U.S. Application Data

[63] Continuation of Ser. No. 77,958, Jul. 27, 1987, abandoned, which is a continuation of Ser. No. 669,698, Nov. 8, 1984, abandoned.

[51] Int. Cl.[5] ..... H01Q 3/22

[52] U.S. Cl. ..... 342/354; 342/371

[58] Field of Search ..... 342/354, 356, 371, 373, 342/447

[56] References Cited

U.S. PATENT DOCUMENTS

| | | | |
|---|---|---|---|
| 3,137,856 | 6/1964 | Tashjian | 343/771 |
| 3,276,018 | 9/1966 | Butler | 342/373 |
| 3,553,706 | 1/1971 | Charlton | 343/777 |
| 3,949,407 | 4/1976 | Jajdman et al. | 343/447 |
| 4,121,220 | 10/1978 | Scillieri et al. | 343/768 |
| 4,163,235 | 7/1979 | Schultz | 343/354 |
| 4,163,974 | 8/1979 | Profera | 342/373 |
| 4,228,436 | 10/1980 | Dufort | 342/373 |
| 4,246,585 | 1/1981 | Mailloux | 342/373 |
| 4,338,605 | 7/1982 | Mims | 342/373 |
| 4,424,500 | 1/1984 | Viola et al. | 342/373 |
| 4,429,313 | 1/1984 | Muhs, Jr. et al. | 343/771 |
| 4,814,775 | 3/1989 | Raab et al. | 342/373 |

FOREIGN PATENT DOCUMENTS 2143681 2/1985 United Kingdom .

OTHER PUBLICATIONS

J. C. McDade, "Modular Integrated Circuit Development for Microwave Phased Array Systems," 1979 Int. Symp. Digest-Antennas & Propagation, vol. 2, (Jun. 1979), pp. 621-624.

*Primary Examiner*—Thomas H. Tarcza
*Assistant Examiner*—Mark Hellner
*Attorney, Agent, or Firm*—Steven M. Mitchell; Wanda Denson-Low

[57] ABSTRACT

A modular direct radiating antenna system for producing highly contoured beam patterns is disclosed. The system comprises a plurality of array modules, each having a number of radiation elements. An intramodule feed network is provided to communicate RF energy between a module port and the radiation elements in an equal-power, equal-phase relationship. A second feed network, an intermodule feed network, is provided to communicate RF energy between an antenna system port and the respective module ports. The second feed network is adapted to couple the power and adjust the electrical path lengths so that the RF power communicate between the respective module ports and the system port is of predetermined relative amplitudes and phases. The intermodule excitation power and phase distribution across the entire planar array aperture produces the desired contoured beam to encompass a required area. The antenna system is well suited to satellite antenna applications and is significantly smaller, more compact, lighter, and less costly than other satellite antenna systems that produce a contoured beam, for example, to encompass a required area seen from a satellite in synchronous orbit.

18 Claims, 8 Drawing Sheets

Fig. 2.
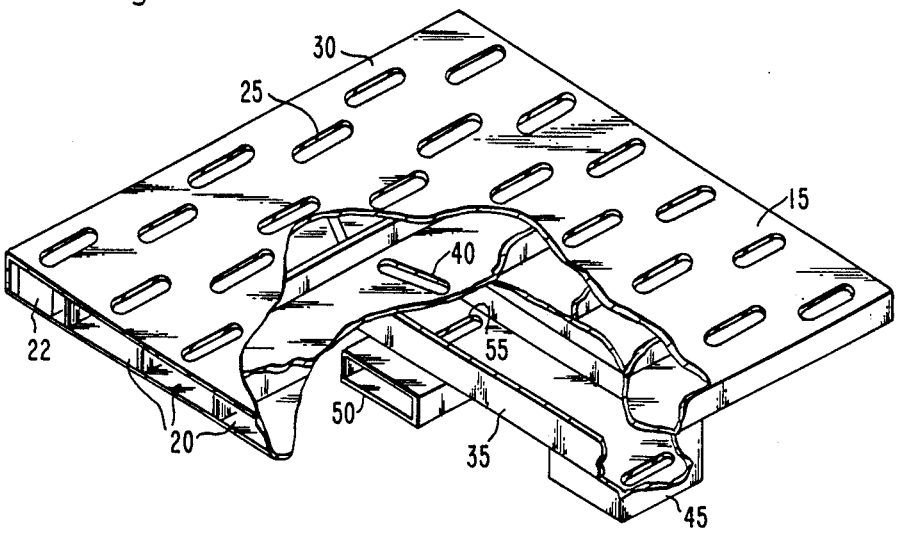
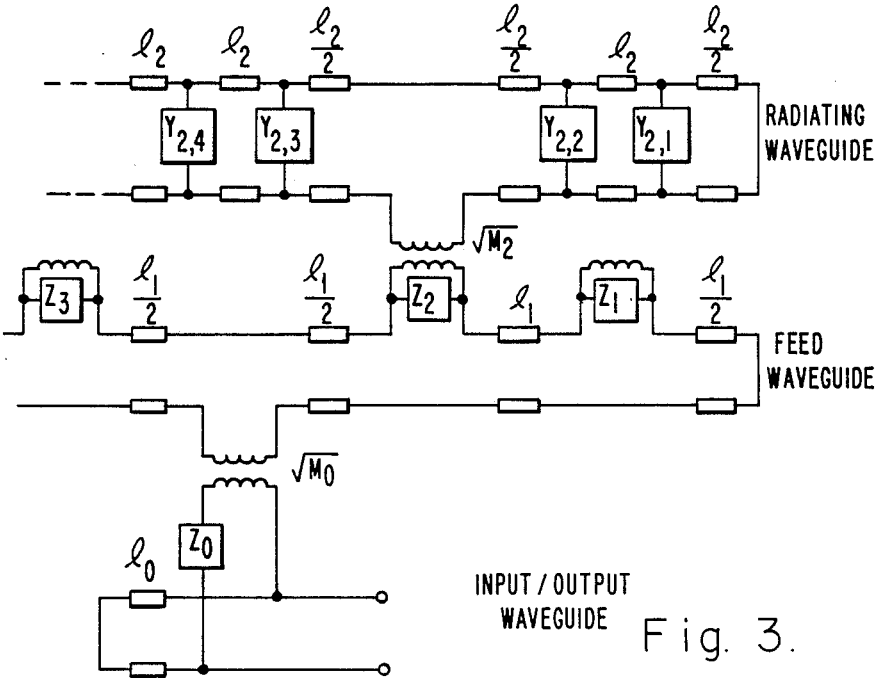
Fig. 3.

Fig. 4.

| | | | | | | | | | |
|---|---|---|---|---|---|---|---|---|---|
| | | .01957<br>89°<br>2 | .00914<br>85°<br>3 | .00914<br>-135°<br>4 | .06460<br>-127°<br>5 | .07815<br>-127°<br>6 | .02197<br>-129°<br>7 | | |
| .00313<br>-111°<br>1 | .00723<br>117°<br>9 | .01739<br>108°<br>10 | .00616<br>-170°<br>11 | .04735<br>-130°<br>12 | .11200<br>-123°<br>13 | .07470<br>-128°<br>14 | .00902<br>172°<br>15 | .00902<br>132°<br>16 | .00989<br>91°<br>8 |
| .00101<br>-148°<br>25 | .01307<br>117°<br>17 | .01291<br>137°<br>18 | .02027<br>-143°<br>19 | .08518<br>-114°<br>20 | .10310<br>-120°<br>21 | .03804<br>-136°<br>22 | .01081<br>150°<br>23 | .01864<br>108°<br>24 | .00314<br>117°<br>32 |
| | | .01011<br>172°<br>26 | .03314<br>-123°<br>27 | .07434<br>-110°<br>28 | .04811<br>-119°<br>29 | .01106<br>-159°<br>30 | .01860<br>123°<br>31 | | |

AZIMUTH
ELEV.
2.10
1.80
1.10
.80
.10
-.40
-.00
-1.40
-1.90
-2.50
-2.00
-1.50
-1.00
-.50
0.00
.50
1.00
1.50
2.00
2.50
3.00
3.50
24.0
25.0
27.0
28.0
29.0
30.5
31.0
32.0
30.0
26.0

MODULARIZED CONTOURED BEAM DIRECT RADIATING ANTENNA

This application is a continuation of application Ser. No. 077,958, filed July 27, 1987, which is a continuation of application Ser. No. 669,698, filed Nov. 8, 1984, both now abandoned.

BACKGROUND OF THE INVENTION

The present invention relates to antenna systems for creation of highly shaped beams of irregular outline.

Communications satellites in geosynchronous orbit are employed to allow communication from one earth station to another. Such satellites typically employ antenna systems engineered for coverage of specific land masses so as not to waste antenna gain over unpopulated areas. Antenna systems for providing highly contoured antenna patterns are, therefore, required to enhance the efficiency of the communication system.

Heretofore, a cluster of waveguide horns feeding a parabolic reflector was the only satellite antenna that produced highly contoured beams. This type of system suffers the disadvantages of high cost, thermal distortion and considerable volume requirements.

Modular phased array antenna systems have long been utilized in radar applications, typically as an element in a radar system to sweep a narrow beam of RF energy past a target and thereby obtain an imaging of the target from the reflected signals. Insofar as is known to applicants, phased array techniques have not been used before for space antenna subsystems because of the relatively high costs associated with standard treatment of their design, and the fact that such standard treatments were not believed to lead to practical configurations for satellite and space configurations.

It is, therefore, one object of the invention to provide a modular phased array antenna system for creating a highly contoured beam pattern.

Another object of the invention is to provide a direct radiating antenna which can create a highly configurable pattern.

Yet another object of the invention is to provide a modular contoured beam phased array which is relatively small, compact, light and less costly than prior art systems.

SUMMARY OF THE INVENTION

A modularized, direct radiating antenna system for producing highly contoured beam patterns is disclosed. The preferred embodiment comprises a plurality of identical array modules, each comprising at least one radiation element. An intramodule feed network is provided to distribute RF energy between a module port and the radiation elements in an equal-power, equal-phase relationship. An intermodule feed network is provided to communicate RF energy between an antenna system port and the respective module ports. The second feed network is adapted to couple the power and provide appropriate electrical path lengths so that the RF power communicated between the respective module ports and the system port is of predetermined relative amplitudes and phases. The intermodule excitation power and phase distribution across the entire planar array produces the desired contoured beam to encompass a required area.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 2 is a cut-away perspective view of a slotted waveguide planar array module in accordance with the invention.

FIG. 3 is a schematic equivalent circuit diagram of the intramodule feed network.

FIG. 4 depicts a planar array comprising thirty-two identical array modules.

DETAILED DESCRIPTION OF THE PREFERRED EMBODIMENT

Figure 1:
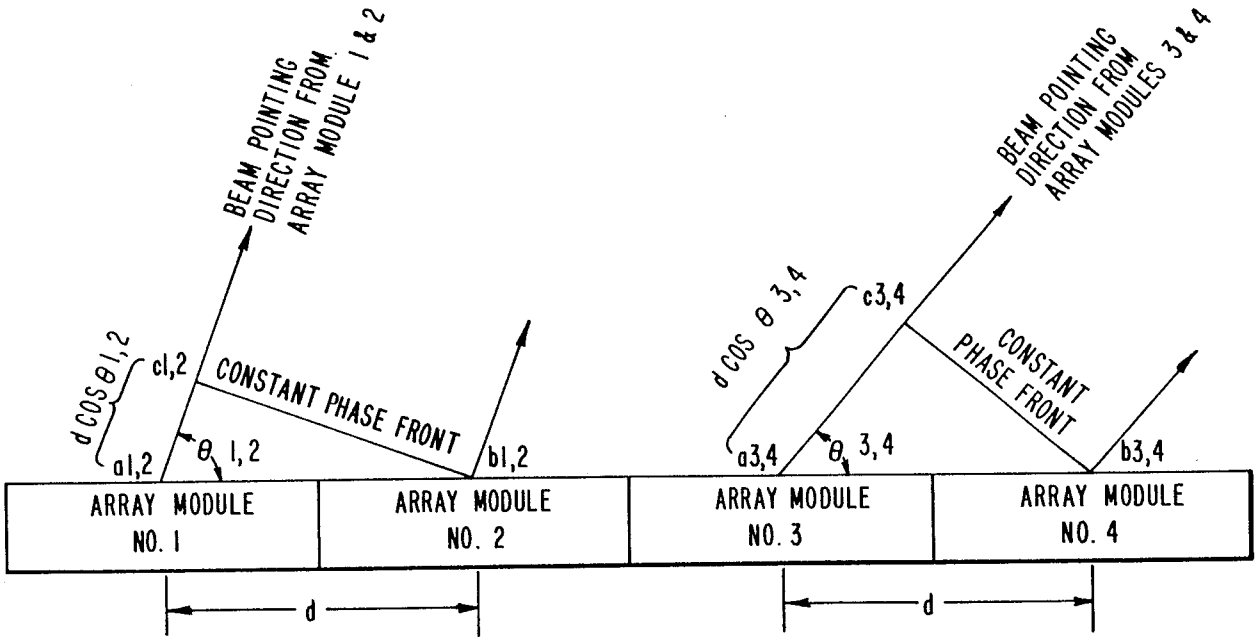
FIG. 1 depicts a one-dimensional view of a planar phased array in accordance with the invention.

The present invention comprises a novel modularized contoured beam phased array antenna. The following description is presented to enable any person skilled in the art to make and use the invention, and is provided in the context of a particular application and its requirements. Various modifications to the preferred embodiment will be readily apparent to those skilled in the art, and the generic principles defined herein may be applied to other embodiments and applications. Thus, the present invention is not intended to be limited to the embodiment shown, but is to be accorded the widest scope consistent with the principles and features disclosed herein.

The presently preferred embodiment of the invention is intended for use as an antenna system for a satellite in geosynchronous orbit above the earth. Thus, the satellite is disposed in geostationary orbit some 22,000 miles above the earth, and the antenna system in accordance with the invention is adapted to provide a radiation beam contour which is highly contoured to cover a particular land mass, for example, the country of Mexico as viewed from a specific geostationary orbit slot, i.e., at a specific longitude.

The present invention represents, insofar as is known to applicants, the first use of planar array technology for creation of very highly shaped beams of irregular outline. With the invention, the array beams are molded into three dimensional contours to achieve specific gain objectives. This type of antenna is not limited to satellite applications, but may create virtually any type of beam configuration (dependent upon available aperture size and frequency). The invention represents a practical, low cost means of providing an optimized antenna for an available spatial envelope.

As will be described in detail below, the preferred embodiment of the array system comprises a plurality of identical array modules, each in turn comprising a plurality of radiation elements and a module port coupled to the radiation elements by an intramodule feed network. The module ports of the array modules are coupled to an array system port by an intermodule feed network adapted to provide predetermined intermodule phase and amplitude excitation. The intermodule excitation power and phase distribution across the entire planar array aperture produces the desired contoured beam to encompass a required area. For a satellite in synchronous orbit, the required area is the desired land mass as viewed from a specific geostationary orbit slot, i.e., at a specific longitude.

Sophisticated optimizer computer techniques have been developed by others to analyze horn array fed reflector antennas, typically used for satellite applications. As is known, each horn feeding the reflector creates a single beam with a different beam pointing direction. An optimizer computer program determines the optimum relative phase and power excitation of the horns in the array to create the desired contoured antenna beam. The paper, "Design of Shaped-Beam Antennas Through Minimax Gain Optimization," Charles A. Klein, IEEE Transactions on Antennas and Propagation, Volume AP-32, No. 9, September, 1984, pages 963–968, provides one example of such an optimizer technique.

In a manner similar to the horn fed reflector system, the optimizer computer program may be employed to determine the optimum relative phase and power excitation of the planar array modules within the entire planar array to create the desired contoured antenna beam.

FIG. 1 provides some insight into the similarity of the known horn array fed reflector antenna system, which in effect superimposes several beams with different beam pointing directions, and the planar array, comprised of several planar array segments or modules. FIG. 1 depicts a one-dimensional view of the planar array. The array modules are treated theoretically as the array elements. The intermodule spacing d is, therefore, the spacing between the centers of adjacent identical array modules. The change in phase from point $a_{1,2}$ to point $c_{1,2}$ is $(2\pi/\lambda)d\cos\theta_{1,2}$, where $\lambda$ is the free space wavelength and $\theta_{1,2}$ is the pointing direction from the plane of the array of a main beam created by considering array modules 1 and 2 only. Likewise, $\theta_{3,4}$ is the pointing direction from the plane of the array of a main beam created by considering array modules 3 and 4 only. $\theta_{1,2}$ and $\theta_{3,4}$ are not necessarily equal.

By considering these beams of adjacent array module pairs to be pointing in different directions, the similarity between the horn array fed reflector antennas and contoured beam modularized planar array antennas becomes apparent. The relative phase between the adjacent array modules 1 and 2, $\phi_{1,2}$ is the phase change between $a_{1,2}$ and $b_{1,2}$, which must also be equal to $(2\pi/\lambda)d\cos\theta_{1,2}$ in order to create the constructive interference of the signals radiating from array modules 1 and 2 to form the main beam pointing at a direction $\theta_{1,2}$ from the plane of the array. For the same reason, $\phi_{3,4}$ is equal to $(2\pi/\lambda)d\cos\theta_{3,4}$. Thus, by analyzing a modularized planar array with an excitation incorporating relative phases $\phi_{n,n+1}$ between adjacent modules, in effect multiple beams are analyzed whose.. beam pointing directions differ by $$\theta n,n+1 = \text{ARC}\cos\left(\frac{\pi\phi_{n,n+1}}{2\pi d}\right).$$

This is analagous to analyzing the horn array fed reflector antennas.

As described above, an optimizer computer program is employed to determine the optimum relative power and phase and excitation of the individual modules of the antenna. For the reflector antenna fed by a cluster of horns, the specific locations of the individual horns each determines a different stationary beam pointing direction corresponding to a specific individual horn. For the modularized phased array with each module independently creating an identically directed beam normal to the plane of the entire array, the resulting optimized relative phases of the array modules are a combination of values that create the dispersion of effective individual beam pointing directions, plus contributions to further create the desired contours.

It is important to recognize that the antenna system of the present invention is not intended for use in a radar system, in which the radar beam is swept past a target to obtain an imaging of the target. Rather, the present antenna system functions in a manner analogous to a holographic processor; that is, the image of the "target" (the particular contoured area) is stored via the nature of the modules and their excitation distribution. Thus, the beam of the present antenna systems is contoured in three dimensions.

In the case of the satellite antenna, the image may be thought of as being projected about 22,000 miles below the antenna. The antenna is perceived as a collection of conducting surfaces which create a crude image of a specified area. It is to be understood that every element or slot of every module illuminates the whole Earth facing the satellite in this application. It is the way the wavelets of energy are collected by the array (in the case of a receive antenna) that creates the desired image. This collective process is frequency coherent. Thus, the antenna comprises a frequency selective, spatially selective set of conductors operating in the communications spectrum, not the visible spectrum of classical holograms.

With this general description of the invention, the structure of the array modules and feed networks will now be described. A cut-away perspective view of an array module as employed in the invention is shown in FIG. 2. The construction of such a module will be generally apparent to those skilled in the art from FIG. 2. The device illustrated is particularly adapted for K band operation, in the range from 14 to 14.5 Ghz. The module comprises a generally rectangular structure defining a plurality of radiating waveguides 20, each having a plurality of radiating slots 25 formed in radiating plate 30. Each radiating waveguide 20 is about 3.302 inches long, and the width of the rectangular structure defining the six waveguides 20 is 3.926 inches. Each waveguide 20 is terminated in a short circuit, for example, at 22. It is noted that the system may be used either for reception or transmission of RF energy; the system functions reciprocally. For clarity of description, the following description of the feed network is in terms of transmission.

A feed waveguide 35 is disposed in a lower transverse relationship with the radiating waveguides 20. A plurality of coupling slots 40 are formed in the feed waveguide 35 and the respective radiating waveguides 20 for coupling energy between the radiating waveguides 20 and the feed waveguide 35. The ends of the feed waveguide are terminated in folded short circuits 45. It is noted that the coupling slots 40 are disposed at an angled disposition relative to the longitudinal axis of the feed waveguide 35.

An input/output waveguide 50 is disposed in transverse relation to the feed waveguide 35. An input slot 55 is formed between the input/output waveguide 50 and feed waveguide 35 for communicating energy between these respective waveguides.

Energy may therefore be provided to the input/output waveguide 50. The input energy is coupled through the input slot 55 into the feed waveguide 35, which is adapted to couple the energy to the radiating waveguides 20 through the respective feed waveguide coupling slots 40. The energy is then radiated from the slots 25 formed in the radiating plate 30. The module structure is adapted so that the energy radiated from each of the radiating slots 25 is substantially equal in power and of the same relative phase as the energy radiated from the other radiating slots 25 of the module.

The use of slotted waveguides to communicate RF energy is known to those skilled in the art. An exemplary reference paper on the subject is "Theory of Slots in Rectangular Waveguides," A.F. Stevenson, Journal of Applied Physics, Vol. 19, January 1948, pages 24–38. To obtain the equal, in-phase power distribution, the radiating slots 25 are disposed at one-half waveguide wavelength spacings along each radiating waveguide 20 and are offset in a staggered relationship on either side of the center axis of the radiating waveguide 20. The centers of the slots 25 adjacent each end of the waveguides 20 are spaced one quarter of the waveguide wavelength from the short circuit. The one-half waveguide wavelength spacing provides 180° phase shift from one adjacent slot 25 to the next, while the offset staggering of the slots 25 results in an additional 180° phase shift from slot to slot, thereby providing a net shift of 360° so that the energy at each slot 25 will be in phase with the energy communicated to the other slots 25.

Referring now to FIG. 3, an equivalent schematic diagram is shown of the planar array module whose structure is illustrated in FIG. 2. The transmission line equivalents for the radiating waveguide 20, the feed waveguide 35 and the input/output waveguide 50 are shown. Thus, for the radiating waveguide 20, transmission line segments indicated by $l_2$ represent the one-half waveguide 20 wavelength $\lambda_g$ line length of the radiating waveguide 20, where $\lambda_g=\lambda_o/(1-(\lambda_o/2a)^2)^{\frac{1}{2}}$, and $\lambda_o$ is the free space wavelength. The transmission line segments indicated by $l_2/2$ represent the one-quarter radiating waveguide 20 wavelength line lengths. The admittances $Y_{2,n}$ represent the admittances of the respective radiating slots 25 in the radiating waveguides 20. Only one of the radiating waveguides 20 is shown in FIG. 3; each of the other radiating waveguides 20 may be represented in a similar manner.

The radiating waveguide 28 is coupled to the feed waveguide 35 by the feed waveguide coupling slots 40; the coupling slots 40 are represented in FIG. 3 by the respective transformers with transformer turn ratio $(M_2)^{\frac{1}{2}}$. The transmission line segments represented by $l_1$ and $l_1/2$ represent, respectively, one-half and one-quarter waveguide wavelength transmission path lengths for the feed waveguide 35. The impedance terms $Z_n$ represent the respective impedances of the feed waveguide coupling slots 40.

The input/output waveguide, 50 is coupled to the feed waveguide by input slot 55. The coupling is represented by the transformer with turns ratio $(M_o)^{\frac{1}{2}}$, and the impedance $Z_o$ represents the impedance of the input slot 55.

It will be understood by those skilled in the art that various other modules and intramodule networks may be designed to accomplish the functions described above and that the particular embodiment shown in FIGS. 2 and 3 is but one exemplary module design. Thus, for example, while the array module shown in FIG. 2 comprises six radiating waveguides, each with six radiating slots, the module could, for example, comprise seven radiating waveguides, each with five radiating slots.

Figure 6:
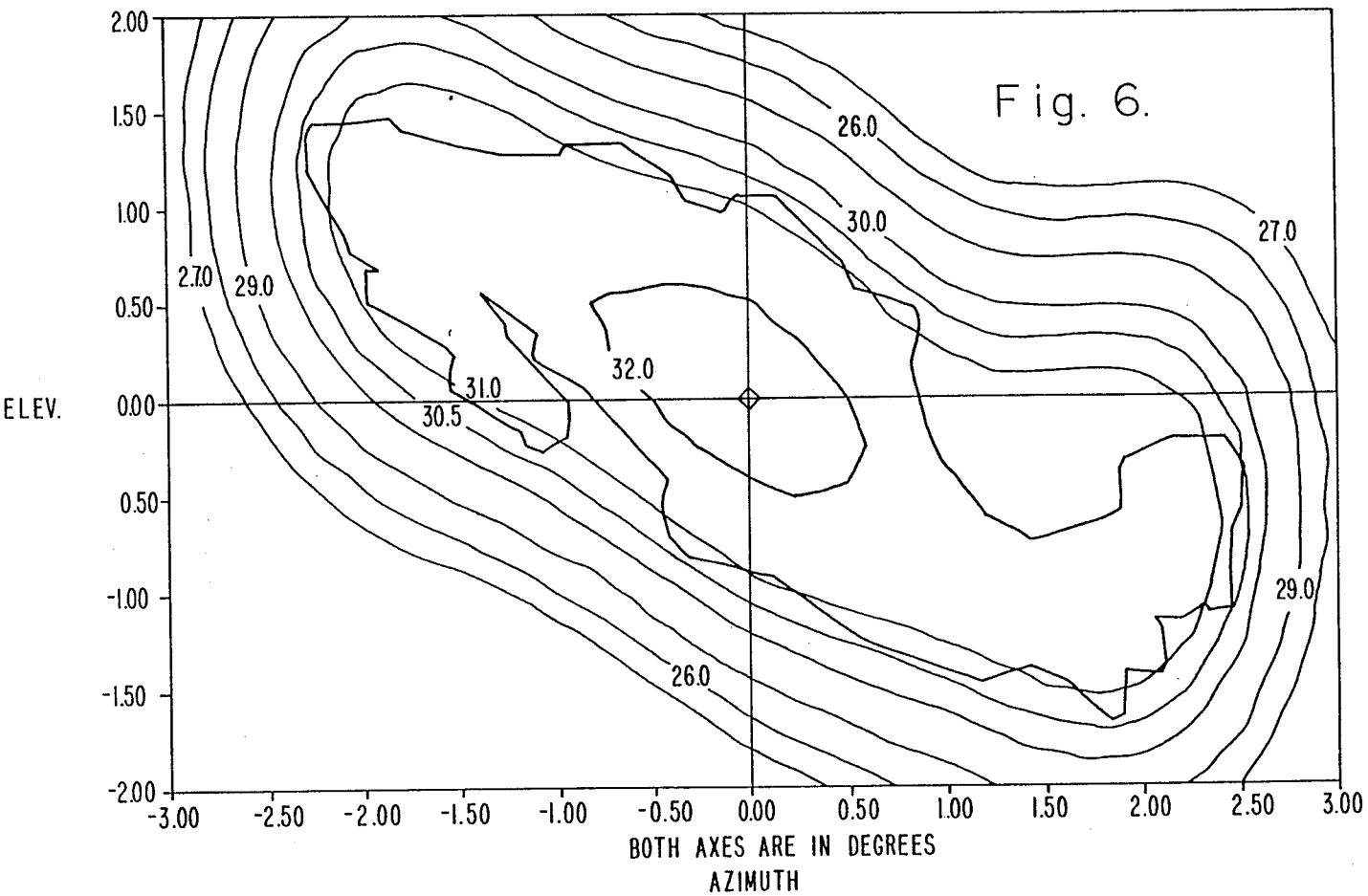
FIG. 6 depicts the theoretically predicted radiation beam pattern contours of the array depicted in FIG. 4.
Figure 7:
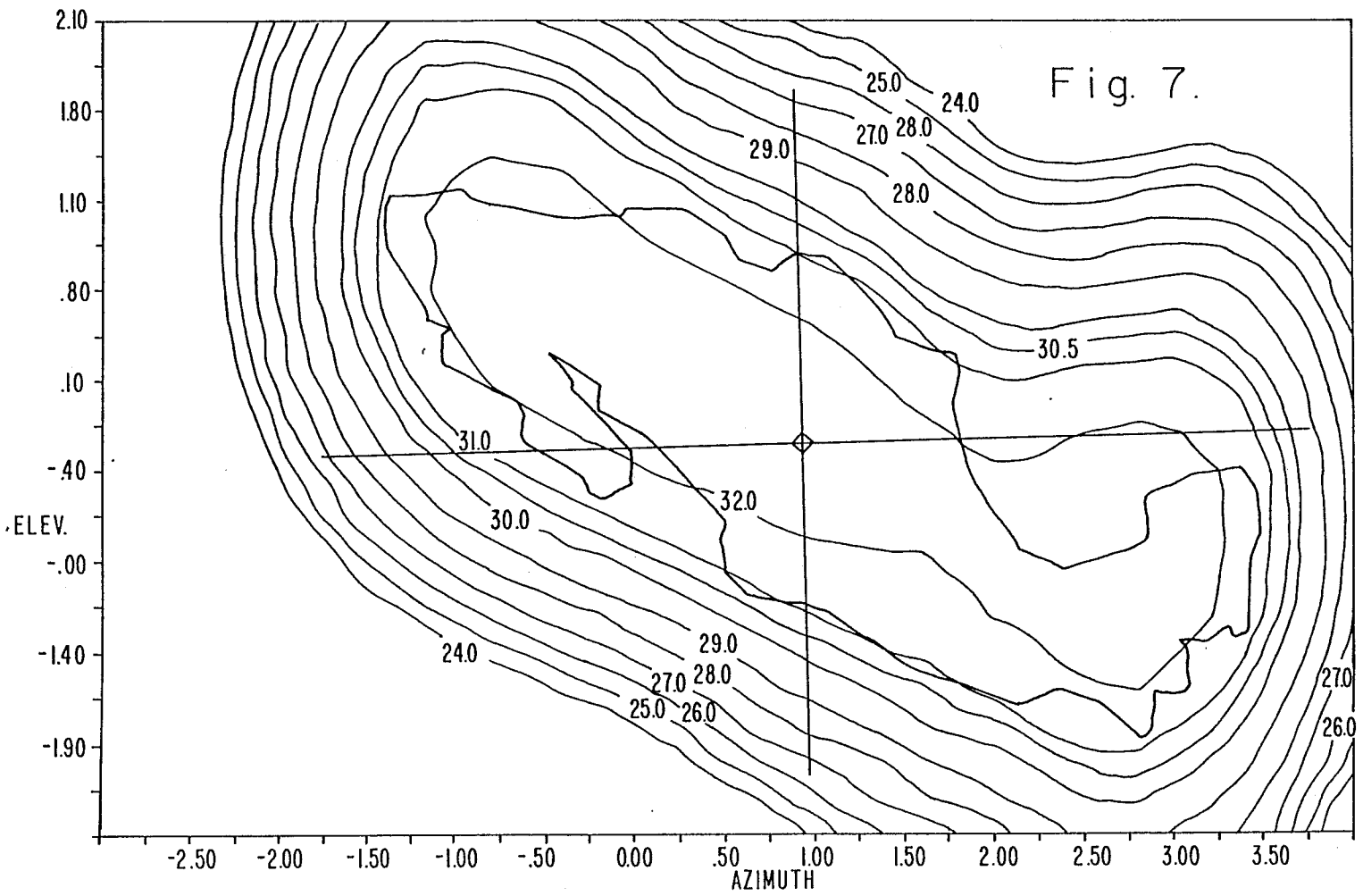
FIG. 7 depicts the measured radiation beam contours of the array depicted in FIG. 4.

Referring now to FIG. 4, a phased array comprising thirty-two identical modules is depicted. Included within the outline of each module are the module number 1–32 and computer-generated, optimized relative power and phase of the excitation of each module required to obtain a predetermined image or contour. FIGS. 5*a–e* illustrate the intermodule feed network for providing the relative power and phase of the excitation for each module. The theoretical radiation contours superimposed on the desired land mass map which correspond to the array and excitation of FIG. 4 are depicted in FIG. 6. FIG. 7 depicts the corresponding measured radiation contours for a prototype of the array system of FIGS. 4 and 5. It is noted that the prototype of the array system measured 33 inches wide, 16 inches high and about one inch thick, including the feed network. Thus, the system is very compact as compared to a reflector and feed system which requires several cubic feet of volume to provide similar contour shape and gain.

In the preferred embodiment, the intermodule feed network is implemented by a "squareax" feed network, developed by a computer-aided design technique. A squareaxial transmission line is a TEM transmission line, differing from coaxial transmission lines by having center and outer conductors of square cross sections, rather than circular. Other implementations, such as a waveguide network, may be readily employed. For purposes of the feed network, the array modules and feed network are divided into quadrants and the feed network is adapted to distribute the power between the input/output terminal 200 and the respective quadrant terminals 220, 240, 260 and 280.

Figure 5A:
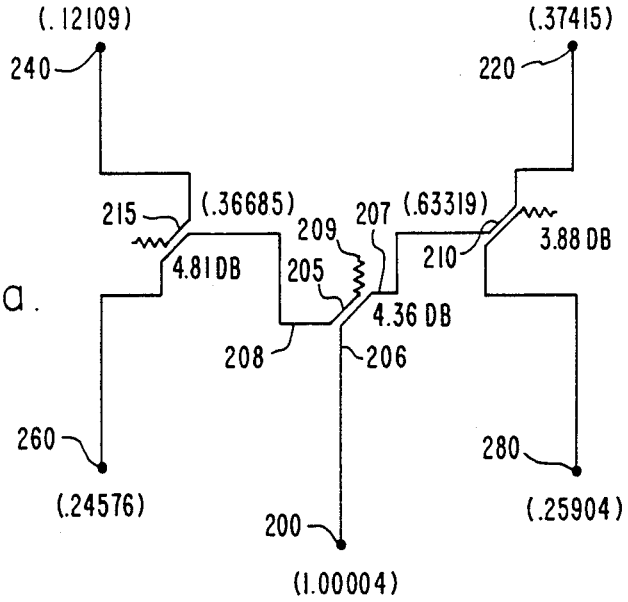
FIGS. 5*a–e* are schematic diagrams illustrating the intermodule feed network for the planar array of FIG. 4.

As shown in FIG. 5*a*, the input signal provided to the intermodule network is applied to the input port of hybrid coupler 205. The isolated port 209 of the coupler is terminated in a load. The direct output 207 of coupler 205 is in turn connected to the input port of coupler 210. The coupled output 208 of coupler 205 is connected to the input port of coupler 215.

The designation 4.36 dB adjacent coupler 205 indicates the value in dB of the ratio of the power level at the coupled output to the power level at the input port to the coupler. The parenthetical value (1.00004) adjacent terminal 200 indicates the relative power of the input signal. Coupler 205 is adapted to divide this signal so that the resulting power level at the direct coupler output is 0.63319, as indicated by the value adjacent port 207 and the resulting power level at the coupled output is 0.36685. Thus, the logarithmic coupler ratio is $10 \log (0.36685/1.00004)=4.36$ dB.

The resultant relative power levels at each of the inputs to the network quadrants are indicated in FIG. 5*a*. Thus, for a relative network input power level of 1.0004, the relative input power levels to the first quadrant at terminal 220 is 0.374, the relative power level to the second quadrant at terminal 240 is 0.12109, the relative power level to the third quadrant at terminal 260 is 0.24576 and the relative power level to the fourth quadrant at terminal 280 is 0.25904.

Figure 5B:
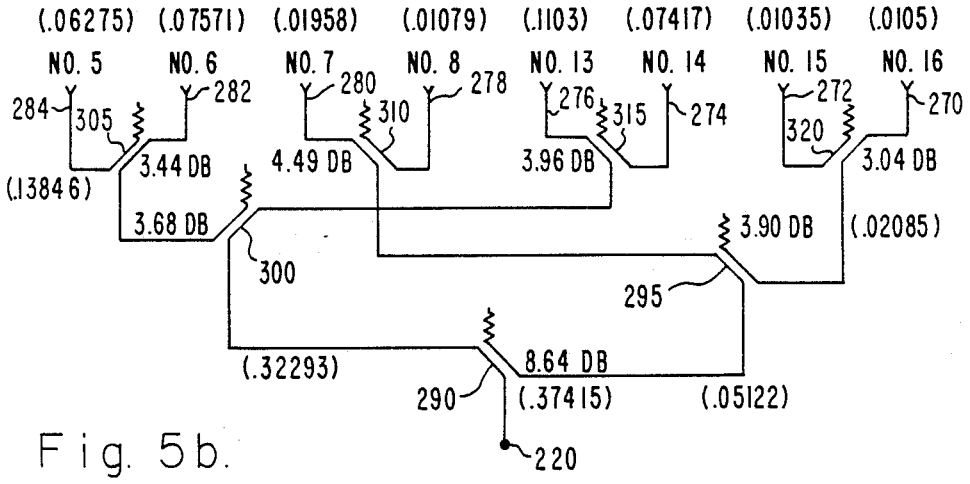

FIG. 5*b* is a schematic diagram of the first quadrant of the feed network. This quadrant of the feed network is adapted to communicate RF energy from the quadrant terminal 220 and the respective array module ports for modules 5, 6, 7, 8, 13, 14, 15 and 16. The module ports for these modules are indicated by respective reference numerals 284, 282, 281, 278, 276, 274, 272 and 270 in FIG. 5*b*. The first quadrant of the feed network comprises hybrid couplers 290, 295, 300, 305, 310, 315 and 320. The coupling coefficients of the respective hybrid couplers are adapted to provide the relative power levels indicated by the parenthetical numerical values shown in FIG. 5*b*. The relative power levels at each of the array module ports are indicated by the parenthetical numerical values shown adjacent the respective module ports.

The intermodule network is also adapted to provide predetermined relative phase shifts between the network port 200 and the module ports. The required signal phase at each array module port is provided by appropriate selection of the relative electrical paths between each module port and the network port. Thus, the network in the disclosed embodiment is designed for operation at a particular K band, 14 to 14.5 Ghz. The signal phase at the direct output port of each squareax coupler lags the signal phase at the coupled port by 90 degrees. Each squareax coupler contributes a nominal $\frac{1}{4}$ wavelength path length, although this may vary according to the coupling coefficient. The design of a feed network to obtain the predetermined relative phase relationships between the network port and module ports will be readily apparent to those skilled in the art and need not be described in further detail.

Figure 5C:
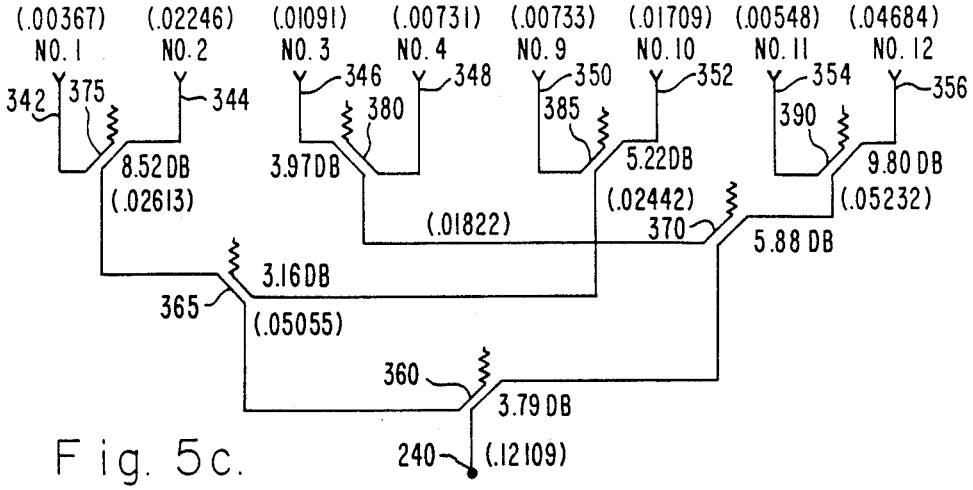

FIG. 5*c* is a schematic of the second quadrant of the feed network. In a similar manner described above with respect to the first quadrant of the feed network, the second quadrant is adapted to communicate RF energy between the quadrant terminal 240 and the module ports for array modules 1-4 and 9-12. The respective module ports are identified by reference numerals 342, 344, 346, 348, 350, 352, 354 and 356. This second quadrant further comprises hybrid couplers 360, 365, 370, 375, 380, 385 and 390. The coupling coefficients of the couplers, indicated in dB on FIG. 5*c*, are adapted to provide the relative power levels indicated by the respective members in parenthesis in FIG. 5*c*.

Figure 5D:
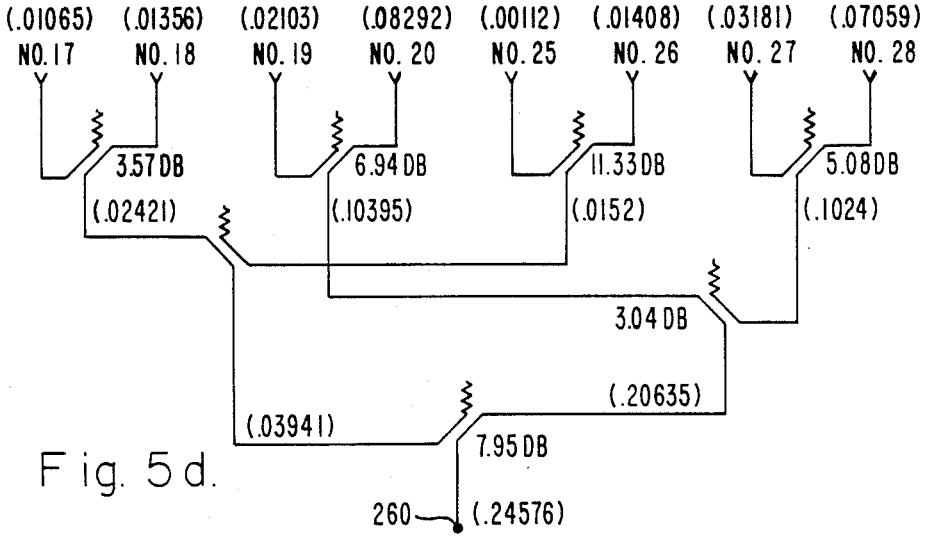
Figure 5E:
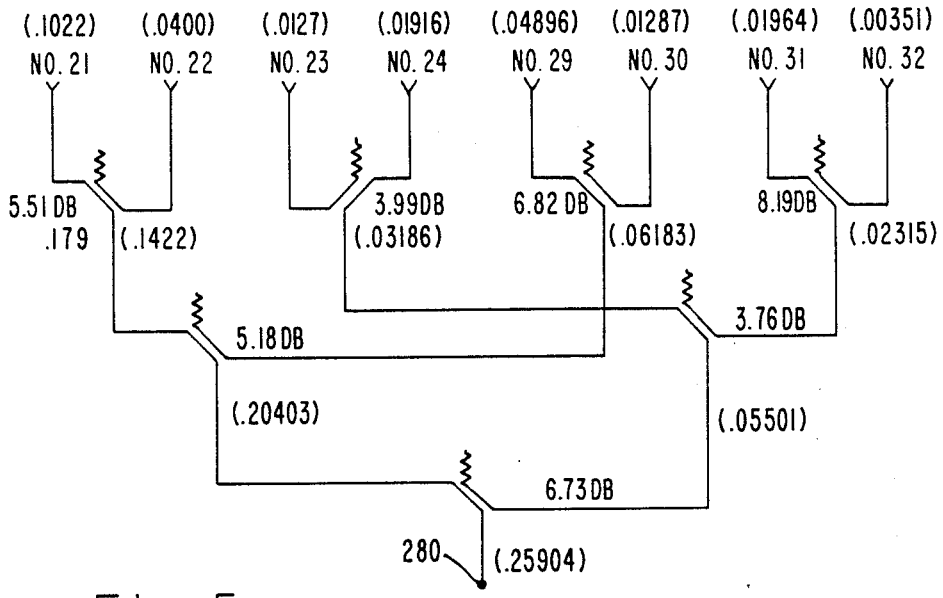

FIGS. 5*d* and 5*e*, respectively, show schematics of the third and fourth quadrants of the feed network. The third quadrant is adapted to couple energy between the input terminal 260 and the module ports for modules 17-20 and 25-28. Similarly, the fourth quadrant is adapted to communicate RF energy between the quadrant terminal 280 and the module ports for modules 21-24 and 29-32. The coupler coefficients for the couplers of third and fourth quadrants are shown in FIGS. 5*c* and 5*e*, respectively, along with the relative power levels at the various ports of the couplers, the module ports and the quadrant terminals.

The embodiment of the invention described above is adapted to provide a fixed radiation pattern, that shown in FIGS. 5 and 6, for a satellite in synchronous orbit. In another implementation, the invention may be employed to provide a real time reconfigurable and/or scanning contoured beam. This capability can be achieved by using couplers and phase shifters with dynamically variable coupling coefficients and phase shifts, respectively. Thus, an array processor may be employed to control these time varying coupling coefficients and phase shifts to produce the desired radiation contour or "image." The optimized coupler coefficients and phase shifts required for each image may be stored in an array processor memory and recalled in dependence upon the particular radiation pattern to be produced.

A direct radiating antenna system has been disclosed which provides highly contoured radiation patterns. The system is capable of employing optimized distributions, an approach which bypasses conventional array techniques. The invention is not limited to use in satellite applications, but can generate virtually any type of beam configuration (dependent upon available aperture size and frequency). A modularized contoured beam phased array can produce any one of an infinite number of contoured beams depending on the intermodule excitation power and phase distribution.

It is to be understood that the invention is not limited to planar arrays of slotted waveguide modules, employed in the disclosed embodiment as a result of the satellite application requirements for high polarization purity and the fact that only a relatively narrow bandwidth was needed. In other applications, the array modules could comprise, for example, a spiral antenna or horn antenna, to increase the bandwidth or obtain circular polarization capabilities. Moreover, each array module of the direct radiating system need include only one radiating element.

The modularized contoured beam array of the present invention is compact, lightweight, efficient and of relatively low cost. The modularized contoured beam phased array technique of the present invention simplifies the design of slotted waveguide planar phased arrays because the module is treated as the common element of the integrated array, instead of the individual radiating slots. The simplification factor is approximately equivalent to the number of slots in each module. Moreover, with the modularization, the available area for the antenna system is broken into manageable subareas (in terms of analytical and cost considerations) and then optimized in such a way to converge toward the ideal antenna. This convergence toward the ideal antenna is not the usual practice in conventional array design, which generally involves special functions to achieve low sidelobes, or fan beams, or $csc^2$ beams or tracking nulls. The technique described herein can accomplish these functions, in addition to creation of highly irregularly shaped beams of various cross sections at several gain levels. The invention offers several ways to treat the antenna area. For example, it need not be planar. The modules need not be all identical. The distribution need not be static but can be dynamic and controllable as in scanning antennas. The antenna basic outline can be any geometry consistent with restrictions caused by the antenna's location.

Another important aspect of the invention is that it allows the development of a standardized array system which may easily be adapted to a particular application's requirement. The design of the array module is in general the expensive aspect of the system design. Once the module has been designed it forms the basis for a standarized system. The intermodule feed network is in general readily adaptable from one application to another without undue expense. Much of the custom design effort previously required for reflector-type antenna systems may be eliminated. Moreover, if linearly polarized modules having a square configuration are used, the polarization may be shifted simply by rotating the modules by 90° on the feed network. This further enhances the flexibility of the system.

It is understood that the above-described embodiment is merely illustrative of the many possible specific embodiments which can represent principles of the present invention. Numerous and varied other arrangements can readily be devised in accordance with these principles by those skilled in the art without departing from the spirit and scope of the invention.

What is claimed is:

1. A modular, phased array antenna system for providing predetermined contoured beam patterns, comprising:

a plurality of array modules, each comprising at least one radiation element, a module port and first network means for communicating RF energy between said radiation elements and said module port;

an array input/output port; and means for communicating RF energy between the respective module ports and said array port, said means including means for providing a dynamic, controllable, non-uniform intermodule power and phase excitation distribution to provide dynamic, controllable contoured beam patterns having irregular outlines.

2. The antenna system of claim 1 further comprising an array processor coupled to said means for communicating RF energy between said module ports and said array port, said processor adapted to provide control signals to provide predetermined intermodule excitation distributions, each for producing a predetermined array system beam pattern.

3. The antenna system of claim 2 wherein said processor means includes memory means for storing data representing said predetermined intermodule excitation distributions.

4. A direct radiating antenna system for providing a contoured beam pattern having an irregular outline, comprising:

a plurality of array modules each including at least one radiating element, a module port and an intramodule network said intramodule network for communicating electromagnetic energy between said at least one radiating element and said module port;

a system port; and an intermodule network for communicating electromagnetic energy between the respective module ports and said system port, said intermodule network including means for providing a predetermined excitation power distribution across said plurality of array modules and means for providing a non-uniform phase distribution across said plurality of array modules to produce a contoured beam pattern.

5. The system of claim 4 wherein the power and phase distibution provided by said intermodule network is optimized in accordance with a computer program.

6. The system of claim 4 wherein each of said array modules includes a plurality of radiation elements comprising waveguide slots.

7. The system of claim 6 wherein each of said waveguide slots is disposed a predetermined distance from each other waveguide slot in the same module to radiate energy that is substantially equal in power and phase distribution to energy radiated by the other slots in the same module.

8. The system of claim 4 wherein each of said at least one radiating elements is a horn antenna.

9. The system of claim 4 wherein said means for providing a non-uniform phase distribution is provided by appropriate selection of relative electrical path lengths between said system port and each of said module ports.

10. The system of claim 4 wherein said means for providing a predetermined excitation power distribution includes a plurality of hybrid couplers having different coupling coefficients.

11. The system of claim 4 wherein said array modules are electrically equivalent module units.

12. The system of claim 11 wherein said array modules comprise a plurality of radiating elements, and said intramodule network of each module is adapted to provide an equal relative power and phase excitation distribution between the module port and the respective module radiating elements.

13. The system of claim 12 wherein each of said array modules comprises a planar radiating surface, and said radiating elements comprise radiating slots formed in said radiating surface.

14. The system of claim 13 wherein each of said intramodule networks further comprises a plurality of radiating waveguides, each communicating with a respective set of said radiating slots.

15. The system of claim 14 wherein each of said intramodule networks further comprises a feed waveguide member disposed in transverse relationship with said radiating waveguides, said feed waveguide communicating with each of said radiating waveguides via a plurality of coupling slots.

16. The system of claim 15 wherein each of said intramodule networks further comprises an input/output waveguide member communicating with said feed waveguide structure via an input/output slot, said input/output waveguide structure further comprising said module port.

17. The system of claim 14 wherein said means for providing a predetermined excitation power is dynamic and controllable.

18. The system of claim 4 wherein said means for providing a non-uniform phase distribution is dynamic and controllable.

* * * * *

UNITED STATES PATENT AND TRADEMARK OFFICE

CERTIFICATE OF CORRECTION

PATENT NO. : 4,949,092

DATED : August 14, 1990

INVENTOR(S) : Timothy A. Crail, Sanford S. Shapiro

It is certified that error appears in the above-identified patent and that said Letters Patent is hereby corrected as shown below:

Title page, after "Assignee:", it should be --Hughes--, not "Highes".

Column 9, line 47, there should be a comma between the words "network" and "said".

Signed and Sealed this

Twenty-eighth Day of January, 1992

*Attest:*

HARRY F. MANBECK, JR.

*Attesting Officer*

*Commissioner of Patents and Trademarks*